US010093496B2

(12) United States Patent
Hyodo

(10) Patent No.: US 10,093,496 B2
(45) Date of Patent: Oct. 9, 2018

(54) STACKING DEVICE AND IMAGE FORMING APPARATUS

(71) Applicant: CANON KABUSHIKI KAISHA, Tokyo (JP)

(72) Inventor: Taisuke Hyodo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/081,695

(22) Filed: Mar. 25, 2016

(65) Prior Publication Data

US 2016/0289018 A1 Oct. 6, 2016

(30) Foreign Application Priority Data

Mar. 31, 2015 (JP) ..... 2015-074302

(51) Int. Cl.
*B65H 1/04* (2006.01)
*B65H 1/26* (2006.01)
*G03G 15/00* (2006.01)

(52) U.S. Cl.
CPC ..... *B65H 1/266* (2013.01); *B65H 1/04* (2013.01); *G03G 15/6502* (2013.01); *B65H 2402/32* (2013.01); *B65H 2405/112* (2013.01); *B65H 2511/10* (2013.01); *B65H 2511/11* (2013.01); *B65H 2511/20* (2013.01); *G03G 2215/00734* (2013.01)

(58) Field of Classification Search
CPC .... B65H 1/04; B65H 1/266; B65H 2301/363; B65H 2301/4222; B65H 2405/1122; B65H 2511/10; B65H 2511/11
USPC ..... 271/171
See application file for complete search history.

(56) References Cited

U.S. PATENT DOCUMENTS 4,697,803 A * 10/1987 Kan ..... B65H 1/12 271/127
5,655,764 A * 8/1997 Ota ..... B65H 1/266 271/171
6,254,085 B1 * 7/2001 Kang ..... B65H 1/04 271/171
7,540,677 B2 * 6/2009 Allwright ..... B41J 13/103 271/162
7,694,960 B2 * 4/2010 Sing ..... B65H 1/266 271/171

(Continued)

FOREIGN PATENT DOCUMENTS

JP 2000-219326 A 8/2000

*Primary Examiner* — Ernesto A Suarez
(74) *Attorney, Agent, or Firm* — Canon U.S.A., Inc. IP Division

(57) ABSTRACT

A stacking device which stacks a sheet includes a stacking unit on which the sheet is configured to be stacked, a regulating member, a moving member, and a restricting member. The regulating member is provided to be movable in a first direction and a second direction, which is a direction opposite to the first direction, and to regulate a position of the sheet stacked on the stacking unit. The moving member moves in a direction that is the same as a moving direction of the regulating member in accordance with the regulating member. The restricting member restricts movement of the moving member. So that the regulating member moves independently of the moving member, the restricting member restricts the movement of the moving member in a partial range of a range in which the regulating member moves.

16 Claims, 6 Drawing Sheets

(56) References Cited

U.S. PATENT DOCUMENTS

| | | | | |
|---|---|---|---|---|
| 7,758,040 | B2 * | 7/2010 | Hashimoto | B65H 1/266<br>271/145 |
| 8,061,708 | B2 * | 11/2011 | Fujita | B65H 1/266<br>271/145 |
| 8,185,037 | B2 * | 5/2012 | Kimijima | B65H 1/266<br>399/389 |
| 2015/0054217 | A1 * | 2/2015 | Hirose | B65H 1/04<br>271/227 |

* cited by examiner

STACKING DEVICE AND IMAGE FORMING APPARATUS

BACKGROUND OF THE INVENTION

Field of the Invention

The present invention relates to a stacking device and an image forming apparatus.

Description of the Related Art

Some of image forming apparatuses such as a copier and a printer include a size detecting device which detects a size of a sheet stacked on a sheet feeding cassette containing a sheet on which an image is formed. As one of such size detecting devices, a configuration in which a size of a sheet in a sheet feeding tray is determined by detecting, with a sensor in a main body side, a detected plate which moves in accordance with a rear edge regulating unit configured to regulate a rear edge of the stacked sheet and be movable has been known. In the above-described conventional art, the detected plate having a length same as a moving amount of the rear edge regulating unit is required, and, since the rear edge regulating unit and the detected plate move integrally, a space in which the detected plate is able to move needs to have a size same as the moving amount of the rear edge regulating unit. Accordingly, there is a problem that a size of a device is increased in a size detecting mechanism described above. In order to solve this problem, Japanese Patent Laid-Open No. 2000-219326 discloses a configuration in which, by including a plurality of detected plates which are configured so as to overlap with each other, a space required for a movement of the detected plates is reduced.

However, in the configuration described in Japanese Patent Laid-Open No. 2000-219326, a level difference is generated between the detected plates due to the configuration in which the detected plates overlap with each other, and another mechanism for correcting an influence of the level difference becomes necessary. As a result thereof, there are problems such as complication of a size detecting mechanism and an increase in a region occupied by the size detecting mechanism in a main body side.

SUMMARY OF THE INVENTION

According to an aspect of the present invention, a stacking device which stacks a sheet, the stacking device includes a stacking unit on which the sheet is configured to be stacked, a regulating member provided to be movable in a first direction and a second direction, which is a direction opposite to the first direction, and to regulate a position of the sheet stacked on the stacking unit, a moving member configured to move in a direction that is the same as a moving direction of the regulating member in accordance with the regulating member, and a restricting member configured to restrict movement of the moving member, wherein, so that the regulating member moves independently of the moving member, the restricting member restricts the movement of the moving member in a partial range of a range in which the regulating member moves.

Provided are a stacking device and an image forming apparatus in which, with a configuration in which a plate for detecting a size moves in accordance with a rear edge regulating plate, the rear edge regulating plate moves independently of the plate and thereby the size of a sheet is able to be detected without complicating the device.

Further features of the present invention will become apparent from the following description of exemplary embodiments with reference to the attached drawings.

DESCRIPTION OF THE EMBODIMENTS

Exemplary Embodiment 1

Figure 1:
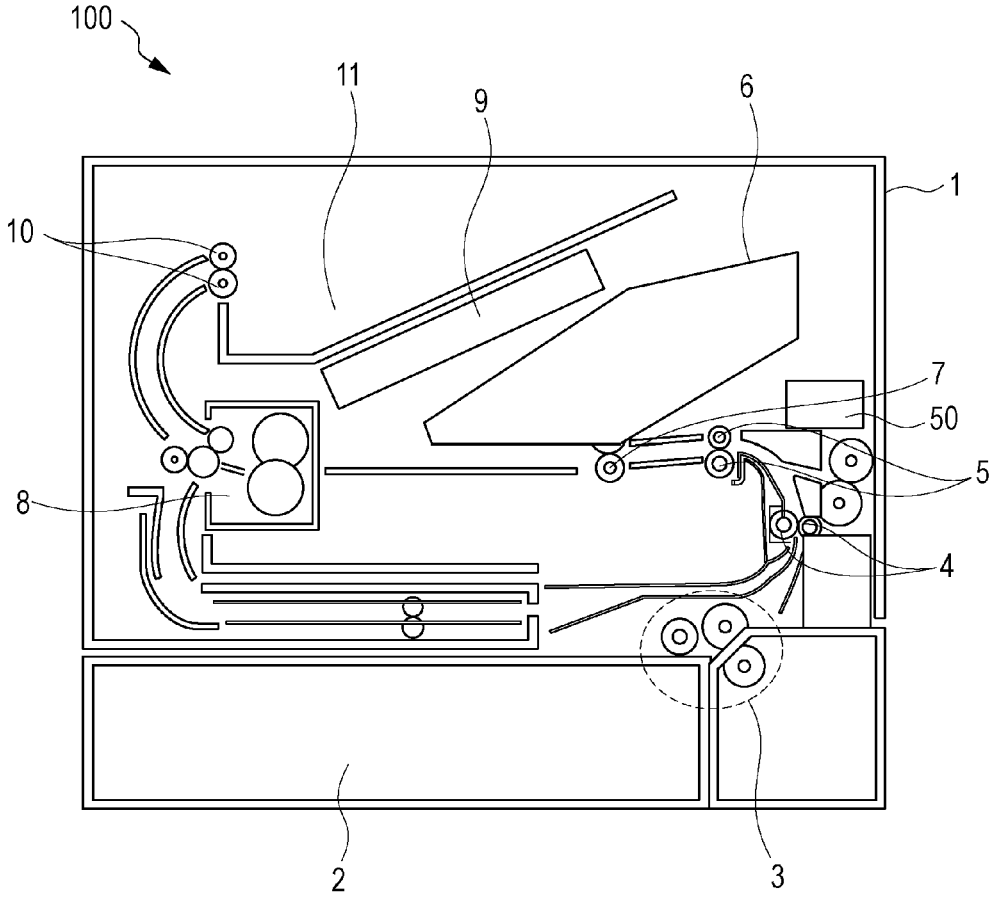
FIG. 1 is a cross section view illustrating an entire configuration of a main body of an image forming apparatus.

FIG. 1 illustrates a laser beam printer of an electrophotographic system which is one example of an image forming apparatus 100 having a configuration according to an exemplary embodiment 1 of the invention. In FIG. 1, 1 denotes an image forming main body unit, and 2 denotes a sheet feeding cassette which contains a sheet material (stacking device). The sheet feeding cassette 2 is configured to be detachably attachable to the image forming main body unit 1, and the sheet feeding cassette 2 is able to be drawn out to a front side in FIG. 1 in the present exemplary embodiment. 3 denotes a group of rollers for sheet feeding, which feeds the sheet material from the sheet feeding cassette 2 to an image forming unit. 4 and 5 denote conveying rollers, and 6 denotes an image formation unit. 7 denotes a transfer roller, 8 denotes a fixing device, 9 denotes a scanner unit, and 10 denotes discharge rollers. 11 denotes an output tray on which the sheet material which has been subjected to image formation is stacked.

Next, an image forming operation will be described. In the image forming apparatus 100 in FIG. 1, which is described above, when printing is started, sheets stacked on the sheet feeding cassette 2 are conveyed to the image forming unit one by one. Next, after processes of a known electrophotographic technique, that is, exposure, development, and transfer, an image is formed on the sheet material, and the image on the sheet material is fixed by the fixing device 8. The sheet material to which the image is fixed is conveyed on a conveying path and discharged on the output tray 11 by the discharge rollers 10.

Figure 2:
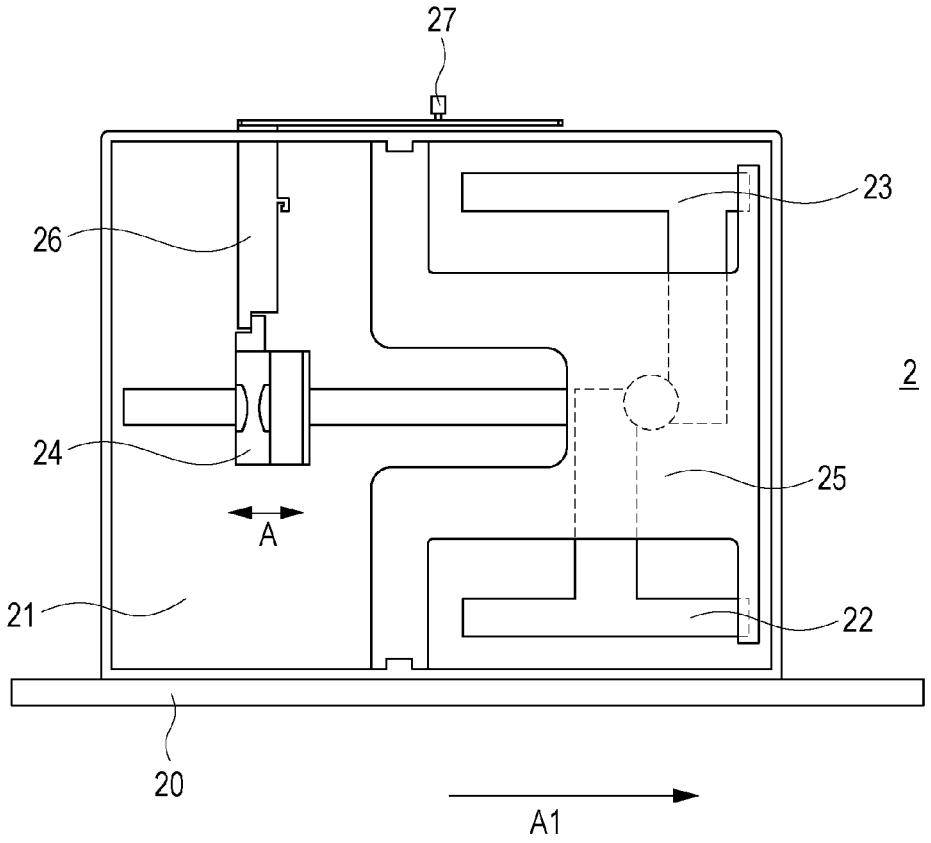
FIG. 2 is a schematic configuration view of a sheet feeding cassette provided in the image forming apparatus.

Next, description will be given in detail for configurations of the sheet feeding cassette 2 and a size detecting mechanism for detecting a size of the sheet material contained in the sheet feeding cassette 2, by using FIG. 2. FIG. 2 is a view for explaining the sheet feeding cassette 2 drawn out from the image forming main body unit 1, and a schematic view of the sheet feeding cassette 2 viewed from the above, which is drawn out from the image forming apparatus 100 described in FIG. 1 to the front side. The sheet feeding cassette 2 illustrated in FIG. 2 includes a sheet feeding tray (stacking unit) 21 on which sheet materials of various sizes is stacked, and a pair of side edge regulating plates 22 and 23 for a sheet material, each of which abuts a side edge of the sheet material to regulate a position of the sheet material. Moreover, the sheet feeding cassette 2 includes a regulating member 24 which abuts a rear edge of the sheet material to regulate a position of the rear edge of the sheet material. In addition, the sheet feeding cassette 2 includes a stacking plate (stacking unit) 25 which pushes the sheet material toward a sheet feeding mechanism. Since the sheet material stacked on the sheet feeding tray 21 is conveyed in a direction of an arrow A1 of FIG. 2 in the present exemplary embodiment, the side edge regulating plates 22 and 23 regulate edge parts in a direction intersecting with a conveyance direction of the sheet material, and the regulating member 24 regulates the position of the rear edge of the sheet material. Hereinafter, the regulating member 24 is referred to as a rear edge regulating plate 24.

The side edge regulating plates 22 and 23 have a configuration that, when one of the side edge regulating plates 22 and 23 is operated, the other one also moves accordingly. The rear edge regulating plate 24 is supported by the sheet feeding cassette 2 so as to be able to slide in a longitudinal direction of the sheet material (direction of A in the figure). A user moves the rear edge regulating plate 24 according to a size of the sheet material to use and sets the rear edge regulating plate 24 so as to abut the rear edge of the sheet material. 26 denotes a plate for detecting the size (moving member) which is movable in the direction of A, which is the same direction as a moving direction of the rear edge regulating plate 24, in accordance with the movement of the rear edge regulating plate 24. Hereinafter, the direction of A1 is referred to as a first direction, and a direction of A2 which is a direction opposite to the direction of A1 is referred to as a second direction.

27 denotes a detecting member used for size detection, which is provided in a main body side and a switch member in the present exemplary embodiment. Hereinafter, description will be given with 27 as a detection switch 27.

Figure 3:
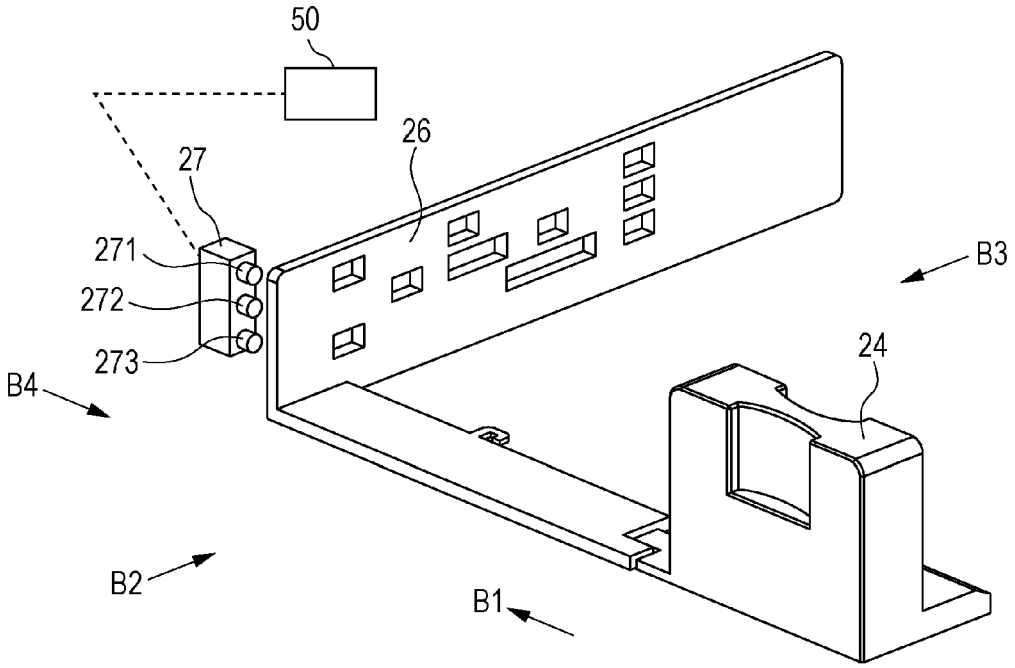
FIG. 3 is a perspective view illustrating an exemplary embodiment 1.

Next, the configuration of the size detecting mechanism will be described in detail. FIG. 3 is a perspective view of the size detecting mechanism of the exemplary embodiment 1. The detection switch 27 has a plurality of push buttons (271, 272, and 273) which turn ON by being pressed by the plate 26. In addition, the plate 26 is provided with hole parts which are arrayed in a specific pattern and through which the plurality of push buttons 271, 272, and 273 pass. A CPU (a control unit and a determination unit) 50 determines a size of the sheet material based on a plurality of types of outputs obtained from combinations of ON and OFF of the plurality of push buttons (271, 272, and 273). In other words, a signal output by the detection switch 27 changes according to a position of the plate 26.

Note that, in the exemplary embodiment 1, provided is the configuration in which three push buttons are included, so that the CPU 50 is able to determine $2^3=8$ sizes of the sheet material. For example, with a configuration in which four push buttons are included, the CPU 50 is able to determine $2^4=16$ sizes of the sheet material.

When the sheet feeding cassette 2 is inserted into the image forming main body unit 1, the plate 26 approaches the detection switch 27 from a direction of B1 in the figure, and the sheet feeding cassette 2 is fixed to a position, at which the detection switch 27 is able to be pressed, in the end. In a state where the push button (271, 272, or 273) of the detection switch 27 faces the hole part of the plate 26, the push button (271, 272, or 273) is not pressed and becomes OFF. In a state where the push button (271, 272, or 273) of the detection switch 27 faces a portion of the plate 26, in which no hole is provided, the push button (271, 272, or 273) is pressed and becomes ON.

Since the position of the plate 26 changes according to a position of the rear edge regulating plate 24, the rear edge regulating plate 24 is set in accordance with the size of the sheet material to use, so that the plate 26 moves to a specific position corresponding to the size of the sheet material.

That is, according to the exemplary embodiment 1, by setting a pattern of the hole parts provided in the plate 26 as a pattern specific to each size of the sheet material, it is possible to change a combination of push buttons (271, 272, and 273) to press. Thereby, it becomes possible to determine the size of the sheet material contained in the sheet feeding cassette 2.

Note that, in the exemplary embodiment 1, a size of a sheet set to be detected is a regular size, and sizes of sheets other than the size set to be detected are set as the same detection pattern as special sizes (irregular sizes) which are common.

Moreover, though the configuration in which the sheet feeding cassette 2 is inserted in the direction of B1 in FIG. 3 is provided in the exemplary embodiment 1, the invention may have a configuration in which the sheet feeding cassette 2 is inserted in a direction of B2 or a direction of B3. Note that, the direction of B2 is the direction of A1 (first direction) of FIG. 2, and the direction of B3 is the direction of A2 (second direction).

Next, a mechanism for detecting the special sizes will be described.

Figure 4A:
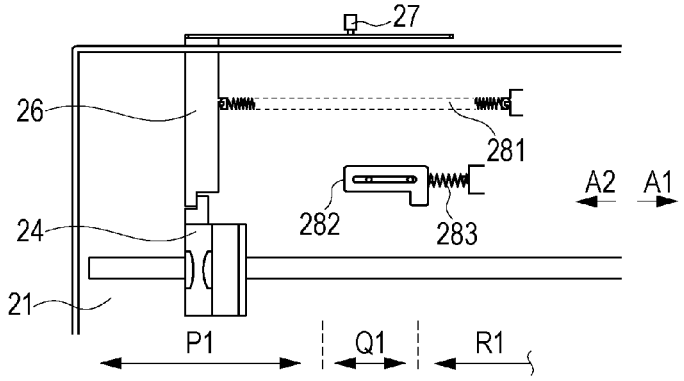
FIGS. 4A to 4C are cross section views illustrating the exemplary embodiment 1.

In FIG. 4A, 281 denotes a plate urging spring (first urging member), 282 denotes a plate stopper (restricting member), and 283 denotes a stopper urging spring (second urging member). The plate 26 is urged in the direction of A1 by the plate urging spring 281.

When the rear edge regulating plate 24 moves in a range of P1 (first range) as illustrated in FIG. 4A, the plate 26 is urged in the direction of A1 (first direction) in the figure by the plate urging spring 281, so that the rear edge regulating plate 24 and the plate 26 move integrally. More specifically, when the rear edge regulating plate 24 moves in the direction of A1, the plate 26 moves in the first direction due to an urging force of the plate urging spring 281. When the rear edge regulating plate 24 moves in the direction of A2 (second direction) which is the direction opposite to the direction of A1, since the plate 26 engages with the rear edge regulating plate 24, the plate 26 moves more in the second direction against the urging force of the plate urging spring 281.

In addition, the plate stopper 282 is supported by the sheet feeding cassette 2 so as to be able to slide in the direction of A1 and the direction of A2. Moreover, the plate stopper 282 is urged in the direction of A2 by the stopper urging spring 283, and stopped in a state of abutting a positioning part not illustrated. When the rear edge regulating plate 24 moves in the direction of A1 in the figure from a state of being in the range of P1 as illustrated in FIG. 4A, an abutting part 26*a* of the plate 26 abuts (engages with) an abutting part (first engaging part) 282*a* of the plate stopper 282 as illustrated in FIG. 4B.

Note that, in the exemplary embodiment 1, a spring force (urging force) of the stopper urging spring 283 which urges the plate stopper 282 is set to be greater than a spring force (urging force) of the plate urging spring 281 which urges the plate 26.

Figure 4B:
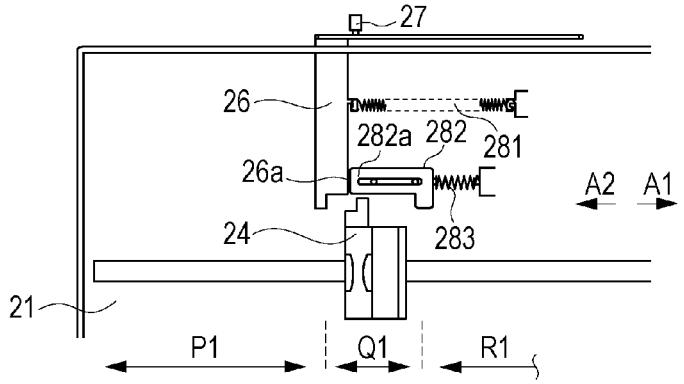

As a result thereof, as illustrated in FIG. 4B, the movement of the plate 26 is restricted in a range of Q1 (second range) in the figure, and only the rear edge regulating plate 24 moves independently. Note that, what the detection switch 27 detects in this state is a special size other than the regular size.

Figure 4C:
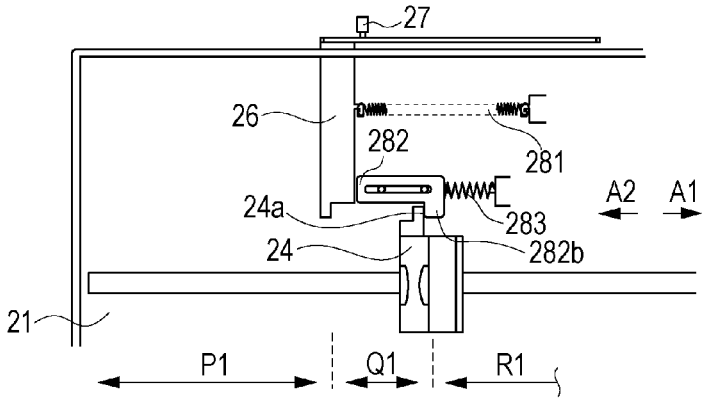

When the rear edge regulating plate 24 further moves in the direction A1 in the figure from a state of being in the range of Q1 as illustrated in FIG. 4B, an abutting part 24*a* of the rear edge regulating plate 24 abuts an abutting part (second engaging part) 282*b* of the plate stopper 282 as illustrated in FIG. 4C. When the rear edge regulating plate 24 further moves in the direction of A1 from a state of FIG. 4C, the rear edge regulating plate 24 and the plate stopper 282 move integrally. Since the plate 26 is urged in the direction of A1 by the plate urging spring 281, the rear edge regulating plate 24 and the plate 26 consequently move integrally in a range of R1 in the figure. Thereby, it is possible to detect a size of a sheet having a small size.

As described above, in the exemplary embodiment 1, a range in which the rear edge regulating plate 24 moves independently of the plate 26 (Q1 in the figure) is included in a partial range of a range in which the rear edge regulating plate 24 moves, so that it is possible to set a range in which the plate 26 moves to be smaller than the range in which the rear edge regulating plate 24 is able to move. As a result thereof, it is possible to reduce a space in the moving direction of the rear edge regulating plate 24, which is required for the movement of the plate 26, thus making it possible to miniaturize the device. Further, according to the exemplary embodiment 1, in the direction of A1, the range of Q1 is provided in a downstream side of the range of P1 and in an upstream side of the range of R1, so that it is possible to detect a size of a sheet having a large size in the range of P1 and detect a size of a sheet having a small size in the range of R1. Note that, when the above-described range in which only the rear edge regulating plate 24 moves is provided in a site in which sizes of adjacent regular sheets have a greatest difference, an effect of miniaturization increases.

Exemplary Embodiment 2

Next, an exemplary embodiment 2 will be described based on FIGS. 5A to 5C. In following description of the exemplary embodiment 2, description for a configuration and an operation which are common to those of the exemplary embodiment 1 will be omitted as appropriate.

In FIGS. 5A to 5C, 30 denotes a rear edge regulating plate (regulating member), and 31 denotes a plate (moving member) for detecting a size. In addition, 32 denotes a connecting pin (connecting part) which connects the plate 31 and the rear edge regulating plate 30, and the rear edge regulating plate 30, the plate 31, and the sheet feeding tray 21 are respectively provided with guiding grooves (guiding parts) 21*a*, 30*a*, and 31*a*, which guide the connecting pin 32.

Figure 5A:
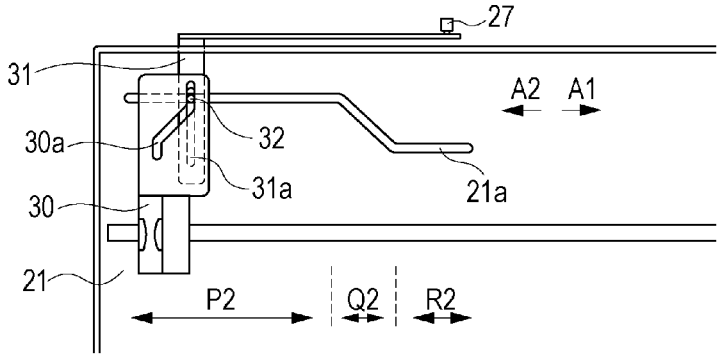
FIGS. 5A to 5C are cross section views illustrating an exemplary embodiment 2.

When the rear edge regulating plate 30 moves in a range of P2 (first range) as illustrated in FIG. 5A, the connecting pin 32 moves in a direction same as a direction, in which the rear edge regulating plate 30 moves, on the guiding groove 21*a* of the sheet feeding tray 21. Accordingly, the rear edge regulating plate 30 and the plate 31 move integrally by the same amount in the range of P2.

Figure 5B:
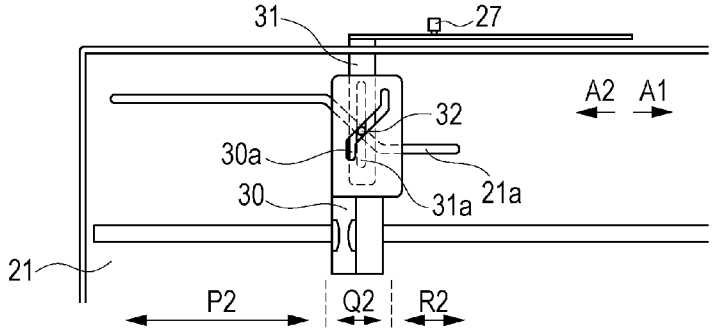

When the rear edge regulating plate 30 moves in a direction of A1 in the figure from a state of being in the range of P2 as illustrated in FIG. 5A, the connecting pin 32 moves in a direction, which is oblique with respect to a moving direction of the rear edge regulating plate 30, on the guiding groove 21*a* of the sheet feeding tray 21 as illustrated in FIG. 5B. In other words, the connecting pin 32 moves in a direction, which is relatively opposite to the moving direction of the rear edge regulating plate 30, in the guiding groove 30*a* of the rear edge regulating plate 30. On the other hand, the connecting pin 32 moves in a direction, which is relatively perpendicular to the moving direction of the rear edge regulating plate 30, in the guiding groove 31*a* of the plate 31. Therefore, in a range of Q2 (second range), there is a difference in moving amounts of the rear edge regulating plate 30 and the plate 31. That is, in the range of Q2, the moving amount of the plate 31 is smaller than the moving amount of the rear edge regulating plate 30.

Figure 5C:
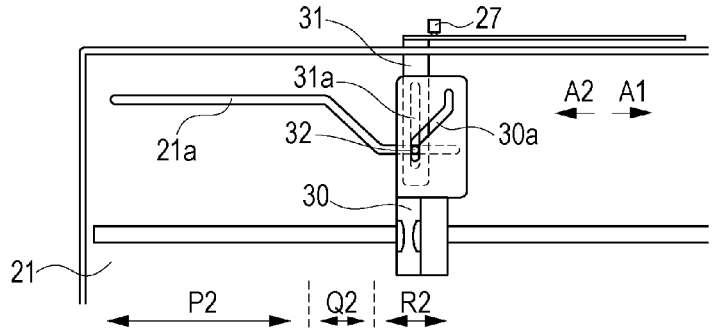

Thereafter, when the rear edge regulating plate 30 further moves in the direction of A1, the connecting pin 32 moves in the direction, which is same as the moving direction of the rear edge regulating plate 30, on the guiding groove 21*a* of the sheet feeding tray 21 again as illustrated in FIG. 5C. As a result thereof, in a range of R2 (third range), the rear edge regulating plate 30 and the plate 31 have the same moving amounts.

As described above, in the exemplary embodiment 2, the range of Q2 in which the moving amount of the plate 31 is smaller than the moving amount of the rear edge regulating plate 30 is included, so that it is possible to set a range in which the plate 31 moves to be smaller than a range in which the rear edge regulating plate 30 is able to move. As a result thereof, it is possible to reduce a space in the moving direction of the rear edge regulating plate 30, which is required for the movement of the plate 31, thus making it possible to miniaturize the device.

Exemplary Embodiment 3

Next, an exemplary embodiment 3 will be described based on FIGS. 6A to 6C. In following description of the exemplary embodiment 3, description for a configuration and an operation which are common to those of the exemplary embodiment 1 will be omitted as appropriate.

Figure 6A:
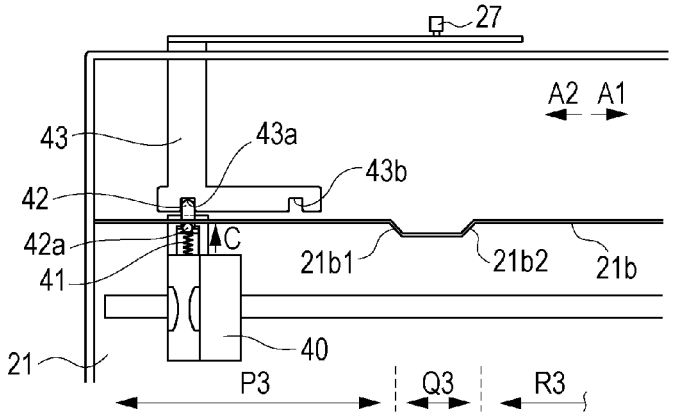
FIGS. 6A to 6C are cross section views illustrating an exemplary embodiment 3.
Figure 6B:
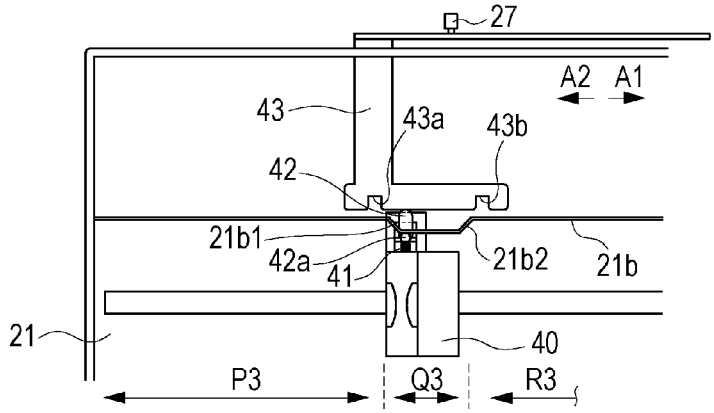

In FIG. 6A, 40 denotes a rear edge regulating plate (regulating member), and 43 denotes a plate (moving member). 42 denotes a connecting member which connects the rear edge regulating plate 40 and the plate 43 and is urged in a direction of C in the figure and pressed against a guiding wall (guiding part) 21*b* of the sheet feeding tray 21 by an urging spring (urging member) 41. In addition, the plate 43 is provided with engaging parts 43*a* and 43*b* with which the connecting member 42 engages.

When the rear edge regulating plate 40 moves in a range of P3 (first range) as illustrated in FIG. 6A, the rear edge regulating plate 40 and the plate 43 are connected by the connecting member 42 and move integrally. When the rear edge regulating plate 40 moves in a direction of A1 in the figure from a state of FIG. 6A, a boss 42*a* of the connecting member 42 is guided by an inclined surface 21*b*1 of the guiding wall 21*b* and the connecting member 42 is separated from the plate 43. Accordingly, the connection of the plate 43 and the rear edge regulating plate 40 is disconnected (released) as FIG. 6B. Thereby, in a range of Q3 (second range) in the figure, provided is a state where only the rear edge regulating plate 40 moves independently and the plate 43 does not move. Note that, what the detection switch 27 detects at this time is a special size other than the regular size.

Figure 6C:
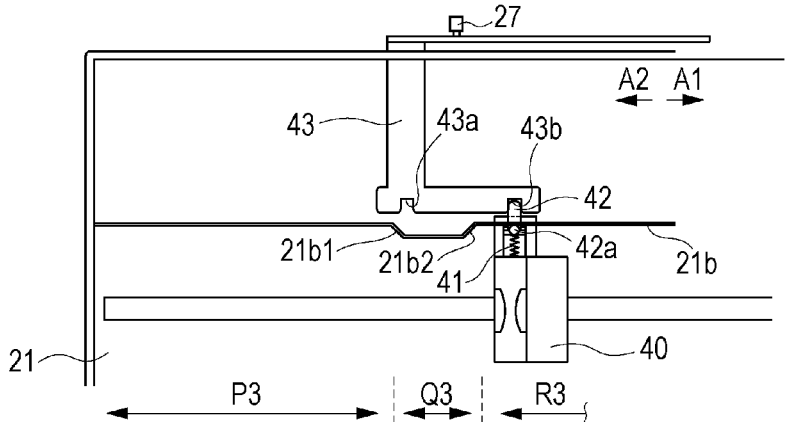

When the rear edge regulating plate 40 further moves in the direction of A1 in the figure, the boss 42*a* of the connecting member 42 moves along an inclined surface 21*b*2 of the guiding wall 21*b* of the sheet feeding tray 21 by the urging spring 41, and the plate 43 and the rear edge regulating plate 40 are brought in a state of being connected again as FIG. 6C. Thereby, in a range of R3 (third range) in the figure, provided is a state where the plate 43 and the rear edge regulating plate 40 move integrally, thus making it possible to detect a size of a sheet having a small size.

As described above, in the exemplary embodiment 3, a range in which the rear edge regulating plate 40 moves independently of the plate 43 (Q3 in the figure) is included, so that it is possible to set a range in which the plate 43 moves to be smaller than a range in which the rear edge regulating plate 40 is able to move. As a result thereof, it is possible to reduce a space in a moving direction of the rear edge regulating plate 40, which is required for the movement of the plate 43, thus making it possible to miniaturize the device.

Note that, when the above-described range in which only the rear edge regulating plate 40 moves is provided in a site in which sizes of adjacent regular sheets have a greatest difference, an effect of miniaturization increases. Further, the number of bosses described above, which engage with the connecting member 42, may be two or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-074302, filed on Mar. 31, 2015, which is hereby incorporated by reference herein in its entirety.

What is claimed is:

1. A stacking device to stack a sheet, the stacking device comprising:

a stacking unit on which the sheet is configured to be stacked;

a regulating member provided to be movable in a first direction and a second direction, which is a direction opposite to the first direction, and to regulate a position of the sheet stacked on the stacking unit;

a moving member configured to move in a direction that is the same as a moving direction of the regulating member in accordance with the regulating member; and a restricting member configured to restrict movement of the moving member, wherein, so that the regulating member moves independently of the moving member, the restricting member restricts the movement of the moving member in a partial range of a range in which the regulating member moves, wherein a moving amount of the regulating member and a moving amount of the moving member are the same in a first range which is a part of the range in which the regulating member moves, wherein the moving amount of the moving member becomes smaller than the moving amount of the regulating member in a second range, which is a part of the range in which the regulating member moves and is a range that is different from the first range, wherein the moving amount of the regulating member and the moving amount of the moving member are the same in a third range, which is a part of the range in which the regulating member moves and is a range that is different from the first range and the second range, and wherein, in the first direction, the second range is in a downstream side of the first range and the second range is in an upstream side of the third range.

2. The stacking device according to claim 1, wherein, in the first range, the regulating member moves with the moving member integrally.

3. The stacking device according to claim 2, wherein, in the second range, the regulating member moves with respect to the moving member independently.

4. The stacking device according to claim 3, wherein, in the third range, the regulating member moves with the moving member integrally.

5. An image forming apparatus comprising:

a stacking unit on which a sheet is configured to be stacked;

an image forming main body unit which forms an image on the sheet stacked on the stacking unit;

a regulating member provided to be movable in a first direction and a second direction, which is a direction opposite to the first direction, and to regulate a position of the sheet stacked on the stacking unit;

a moving member configured to move in a direction that is the same as a moving direction of the regulating member in accordance with the regulating member; and a detecting member having an output that changes according to a position of the moving member;

a determination unit configured to determine a size of the sheet based on the output of the detecting member; and a restricting member configured to restrict movement of the moving member, wherein, so that the regulating member moves independently of the moving member, the restricting member restricts the movement of the moving member in a partial range of a range in which the regulating member moves, wherein a moving amount of the regulating member and a moving amount of the moving member are the same in a first range which is a part of the range in which the regulating member moves, wherein the moving amount of the moving member becomes smaller than the moving amount of the regulating member in a second range, which is a part of the range in which the regulating member moves and is a range that is different from the first range, wherein the moving amount of the regulating member and the moving amount of the moving member are the same in a third range, which is a part of the range in which the regulating member moves and is a range that is different from the first range and the second range, and wherein, in the first direction, the second range is in a downstream side of the first range and the second range is in an upstream side of the third range.

6. The image forming apparatus according to claim 5, wherein the output of the detecting member does not change in a case where the regulating member moves in the second range.

7. The image forming apparatus according to claim 6, further comprising a first urging member configured to urge the moving member in the first direction, wherein, in a case where the regulating member moves in the first direction in the first range, the moving member moves in the first direction due to an urging force of the first urging member, and wherein, in a case where the regulating member moves in the second direction in the first range, the regulating member pushes the moving member against the urging force of the first urging member and thereby the moving member moves in the second direction.

8. The image forming apparatus according to claim 6, wherein the restricting member includes a first engaging part which engages with the moving member and has a second urging member configured to urge the restricting member in the second direction, and wherein, in a case where the regulating member moves in the first direction in the second range, the first engaging part engages with the moving member so that the moving amount of the moving member is restricted.

9. The image forming apparatus according to claim 8, wherein, in a case where the regulating member moves in the first direction in the second range, the moving member stops in a state of abutting the first engaging part.

10. The image forming apparatus according to claim 9, further comprising a first urging member configured to urge the moving member in the first direction, wherein, in a case where the regulating member moves in the first direction in the first range, the moving member moves in the first direction due to an urging force of the first urging member, wherein, in a case where the regulating member moves in the second direction in the first range, the regulating member pushes the moving member against the urging force of the first urging member and thereby the moving member moves in the second direction, and wherein an urging force of the second urging member is greater than the urging force of the first urging member.

11. The image forming apparatus according to claim 5, wherein, in the first range, the regulating member moves with the moving member integrally.

12. The image forming apparatus according to claim 11, wherein, in the second range, the regulating member moves with respect to the moving member independently.

13. The image forming apparatus according to claim 12, wherein, in the third range, the regulating member moves with the moving member integrally.

14. A stacking device to stack a sheet, the stacking device comprising:

a stacking unit on which the sheet is configured to be stacked;

a regulating member configured to be movable in a first direction and a second direction, which is a direction opposite to the first direction, and to regulate a position of the sheet stacked on the stacking unit;

a moving member configured to move in a direction that is the same as a moving direction of the regulating member in accordance with the regulating member; and a restricting member configured to restrict movement of the moving member so that, while the regulating member is continuously moved, the moving member moves in contact with the regulating member, stops moving in contact with the restricting member, and then moves again in contact with the restricting member in a case where the regulating member contacts the restricting member.

15. The stacking device according to claim 14, wherein a moving amount of the regulating member and a moving amount of the moving member are the same in a first range which is a part of a range in which the regulating member moves, wherein the moving amount of the moving member becomes smaller than the moving amount of the regulating member in a second range, which is a part of the range in which the regulating member moves and is a range that is different from the first range, and wherein the moving amount of the regulating member and the moving amount of the moving member are the same in a third range, which is a part of the range in which the regulating member moves and is a range that is different from the first range and the second range.

16. The stacking device according to claim 15, wherein, in the first direction, the second range is in a downstream side of the first range and the second range is in an upstream side of the third range.

* * * * *